US012774808B2

(12) United States Patent
Li et al.

(10) Patent No.: US 12,774,808 B2
(45) Date of Patent: Oct. 27, 2026

(54) BIOMASS FUEL BURNING FURNACE

(71) Applicant: Zhongshan Junwei Home Appliances Co., Ltd., Zhongshan (CN)

(72) Inventors: Enquan Li, Zhongshan (CN); Guangzhi Mai, Zhongshan (CN); Dongsheng Guo, Zhongshan (CN); Zhensheng He, Zhongshan (CN)

(73) Assignee: Zhongshan Junwei Home Appliances Co., Ltd., Zhongshan (CN)

( * ) Notice: Subject to any disclaimer, the term of this patent is extended or adjusted under 35 U.S.C. 154(b) by 394 days.

(21) Appl. No.: 18/602,080

(22) Filed: Mar. 12, 2024

(65) Prior Publication Data

US 2024/0410569 A1 Dec. 12, 2024

(30) Foreign Application Priority Data

Jun. 9, 2023 (CN) ..... 202321479280.X
Nov. 3, 2023 (CN) ..... 202322979277.0
Nov. 3, 2023 (CN) ..... 202322979291.0

(51) Int. Cl.
*F23C 6/04* (2006.01)

(52) U.S. Cl.
CPC ..... *F23C 6/045* (2013.01); *F23C 2201/101* (2013.01); *F23C 2900/06041* (2013.01)

(58) Field of Classification Search
None
See application file for complete search history.

(56) References Cited

U.S. PATENT DOCUMENTS 2,157,195 A * 5/1939 Weeks ..... F23B 90/00 110/294
2,295,781 A * 9/1942 Jullan ..... F24B 5/04 126/76
8,020,547 B2 * 9/2011 Hepper ..... F24B 1/10 126/73
9,995,489 B2 * 6/2018 Amlin ..... F23B 80/04
11,041,627 B1 * 6/2021 Amlin ..... F24B 5/026
2007/0186920 A1 * 8/2007 Wisener ..... F24B 1/024 126/73
2009/0038603 A1 * 2/2009 Hepper ..... F24B 1/024 126/73
2018/0142886 A1 * 5/2018 Huddleston ..... F23B 50/06
2022/0090780 A1 * 3/2022 Spevak ..... F24B 1/024

* cited by examiner

*Primary Examiner* — Jorge A Pereiro

(57) ABSTRACT

Disclosed in the present disclosure is a biomass fuel burning furnace, including: a furnace body, provided with a first air inlet and a fuel inlet, provided with a first combustion chamber, a second combustion chamber, and a third combustion chamber sequentially communicating within the furnace body, wherein the first combustion chamber is used to receive biomass fuel, the second combustion chamber is used for a combustion of the flue gases and for obtaining a mixture to be combusted, and the third combustion chamber is used for directing a flame resulting from the combustion of flue gases in the mixture to be combusted; a fuel-input funnel for feeding biomass fuel; and a revolving door for an opening or a closure of the adjustable air inlet on the fuel-input funnel.

19 Claims, 14 Drawing Sheets

BIOMASS FUEL BURNING FURNACE

CROSS-REFERENCE TO RELATED APPLICATIONS

The present disclosure claims priority of Chinese Patent Application No. 202322979291.0 filed on Nov. 3, 2023, No. 202322979277.0 filed on Nov. 3, 2023, and No. 202321479280.X filed on Jun. 9, 2023 before CNIPA. All the above are hereby incorporated by reference in their entirety as part of the present disclosure.

FIELD

The present disclosure relates to the technical field of burning devices and, particularly, a biomass fuel burning furnace.

BACKGROUND

Biomass fuel is a granular environment-friendly new energy material processed from stalks, dung of cattle and sheep, rice straw, rice husk, peanut shells, corn kernel, cottonseed shells, as well as the "three remnants". Currently, equipment for heating by burning biomass particles has been widely used.

These existing heating appliances are used by feeding biomass fuel into the furnace body through a feed hopper, where the biomass fuel is combusted in a first chamber, and the flame and some of the flue gases flow into a second chamber for complete combustion, with the flame exiting from a chimney connected to the second chamber. However, since the feed hopper is also of a certain height, it is also equivalent to a chimney. After completing the combustion of biomass fuel, there will be smoke returning to the feed hopper, which eventually leads to smoke running out from the feed hopper and polluting the environment.

SUMMARY

In order to solve at least one of the above existing problems of the prior art, in accordance with an aspect of the present disclosure, provided is a biomass fuel burning furnace, including: a furnace body, provided with a first air inlet for inflowing air into the furnace body and a fuel inlet for feeding biomass fuel into the furnace body, provided with a first combustion chamber, a second combustion chamber, and a third combustion chamber sequentially communicating within the furnace body, wherein the first combustion chamber is used to receive biomass fuel conveyed from the fuel inlet for an initial combustion of the biomass fuel and a generation of flue gases, the second combustion chamber is used for a combustion of the flue gases and for a mixing of the flue gases with oxygen inflow from the first air inlet to obtain a mixture to be combusted, and the third combustion chamber is used for a combustion of the flue gases in the mixture to be combusted; a combustion guide conduit, connected to the furnace body and connected to the third combustion chamber for directing a flame resulting from the combustion of flue gases in the mixture to be combusted;

a fuel-input funnel, mounted on the furnace body and connected to the fuel inlet for feeding biomass fuel into the fuel inlet, a side wall of the fuel-input funnel being provided with an adjustable air inlet; and a revolving door, rotatably provided with respect to the fuel-input funnel, and a gravity center of the revolving door being shifted away from a rotation axis of the revolving door, allowing for a closure of the adjustable air inlet under a pressure of the biomass fuel, and for an opening of the adjustable air inlet by own gravity when losing a pressure of the biomass fuel.

In some implementations, the furnace body includes a housing and an enclosing frame provided within the housing;

the housing is provided with the first air inlet; and the second combustion chamber is formed within the enclosing frame, in which the enclosing frame is provided with a second air inlet in communication with the first combustion chamber and a first air outlet in communication with the third combustion chamber.

In some implementations, a part of the combustion guide conduit is provided within the third combustion chamber, the enclosing frame is enclosed out of the combustion guide conduit, and the second combustion chamber is formed by enclosing between the enclosing frame and the combustion guide conduit.

In some implementations, the enclosing frame includes a plurality of vertical enclosing plates and a support plate provided below the plurality of vertical enclosing plates, the vertical enclosing plate is provided with the second air inlet, and the support plate is for mounting the combustion guide conduit and is provided with the first air outlet.

In some implementations, a part of the combustion guide conduit enclosed by the vertical enclosing plate is provided with a third air inlet, and the third air inlet is in communication with the second combustion chamber.

In some implementations, a side of the enclosing frame facing the first combustion chamber is provided with a first gap, a second gap is provided in an area, corresponding to the first gap, of the combustion guide conduit, and a projected arc formed by the second gap on a reference plane in a vertical direction is at least a quarter of a projected circumference formed by the combustion guide conduit on the reference plane.

In some implementations, the combustion guide conduit includes a first section, a second section and a third section in sequence from bottom to top;

the first section is positioned in the third combustion chamber, and a diameter of the first section is gradually increased from bottom to top;

the enclosing frame and an end of the second section connected to the first section are enclosed to form the second combustion chamber, the second section is provided with the third air inlet and the second gap, and a diameter of the second section is constant; and a diameter of the third section is gradually decreased from bottom to top.

In some implementations, a side wall of the second section is provided with a fourth air inlet, and/or a side wall of the third section is provided with a fifth air inlet.

In some implementations, a heat storage cover connected to the furnace body and covering the combustion guide conduit positioned out of the furnace body.

In some implementations, the first air inlet is provided corresponding to the third combustion chamber and the second combustion chamber, the furnace body is further provided with a main air inlet, the main air inlet is provided corresponding to the first combustion chamber, and an opening area of the main air inlet is larger than an opening area of the first air inlet.

In some implementations, a first support and a second support;

the first support is provided in the first combustion chamber to support a heating element for heating the biomass fuel; and the second support is provided in the third combustion chamber and positioned below the combustion guide conduit to support a heating element for heating the mixture to be combusted.

In some implementations, a fuel-guiding shelf, provided in the first combustion chamber, is used to support the biomass fuel inputted from the fuel inlet, and is provided with an air inlet gap.

In some implementations, the fuel-guiding shelf is disposed angled upwardly in a direction distal to the second combustion chamber.

In some implementations, a sliding separator is slidably provided with respect to the fuel-input funnel and/or the furnace body to open or close the fuel inlet.

In some implementations, the fuel-input funnel includes a fuel-input section and a buffer section in sequence from top to bottom, the buffer section is connected to the first combustion chamber, and the sliding separator is slidably provided between the fuel-input section and the buffer section.

In some implementations, the sliding separator includes a barrier part and a fuel-guiding part, the barrier part is slidably provided between the fuel-input section and the buffer section for opening or closing a communicating opening, connected to the fuel-input section, of the buffer section, and the fuel-guiding part is provided angled upwardly in a direction from the furnace body to the fuel-input section.

In some implementations, a side wall of the buffer section corresponding to a sliding direction of the fuel-guiding part is disposed at an angle, and the side wall and the fuel-guiding part share a same angled direction.

In some implementations, the barrier part is provided with a fuel-input opening for being in communication with the communicating opening to open the fuel inlet by the barrier part or for crisscrossing the communicating opening to close the fuel inlet by the barrier part.

Figure 1:
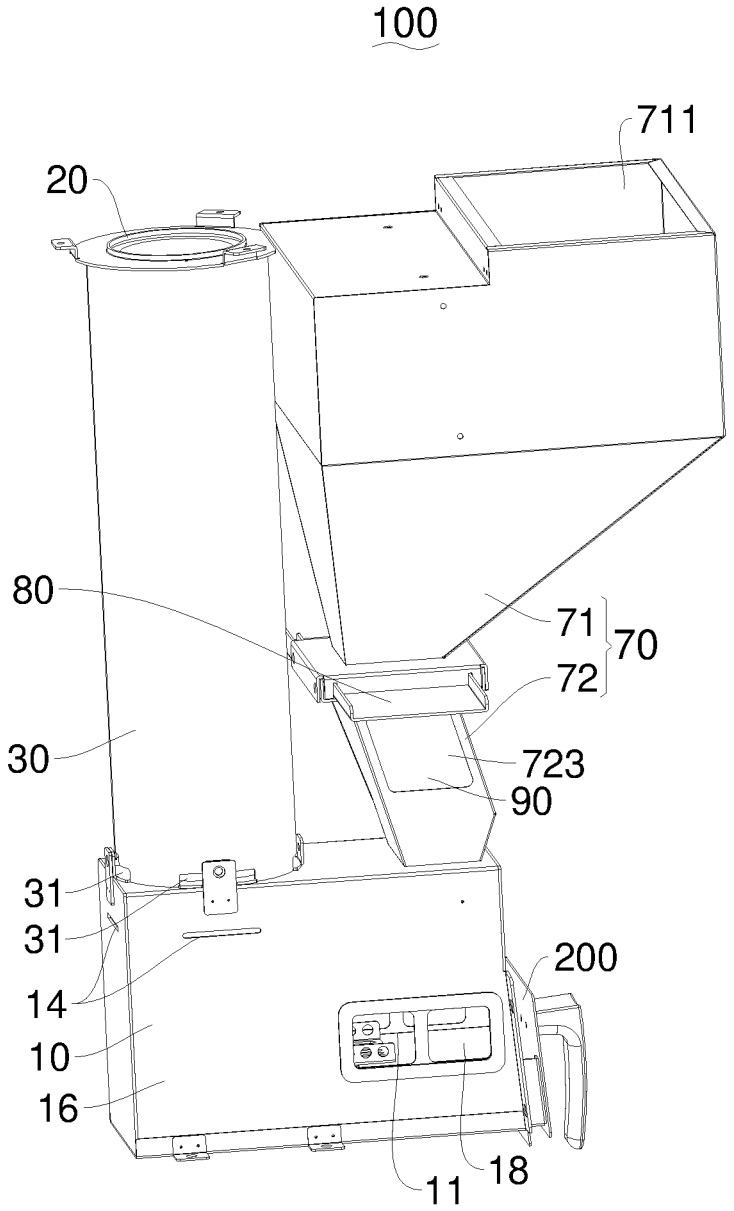
FIG. 1 is a perspective diagram of one view of the biomass fuel burning furnace in the embodiment of the present disclosure.

Labels: 100 biomass fuel burning furnace; 10 furnace body; 11 first combustion chamber; 12 second combustion chamber; 13 third combustion chamber; 14 first air inlet; 15 fuel inlet; 16 housing; 17 enclosing frame; 171 second air inlet; 172 first air outlet; 173 vertical enclosing plate; 174 support plate; 175 first gap; 18 main air inlet; 20 combustion guide conduit; 21 third air inlet; 22 second gap; 23 first section; 24 second section; 241 fourth air inlet; 25 third section; 251 fifth air inlet; 30 heat storage cover; 31 sixth air inlet; 40 first support; 50 second support; 60 fuel-guiding shelf; 61 air inlet gap; 62 fuel-guiding tube; 63 connecting tube; 64 adapter frame; 70 fuel-input funnel; 71 fuel-input section; 711 input opening; 712 funnel part; 713 guiding part; 714 restricting part; 715 third gap; 716 sliding slot; 717 inserted slot; 72 buffer section; 721 communicating opening; 722 angled side wall; 723 adjustable air inlet; 724 buffer part; 725 mounting part; 7251 mounting plate; 7252 insertion plate; 80 sliding separator; 81 barrier part; 811 fuel-input opening; 812 horizontal plate; 813 vertical plate; 82 fuel-guiding part; 90 revolving door; 91 retainment plate; 911 eighth air inlet; 92 lateral plate; 921 connecting hole; 200 ash receiver.

DETAILED DESCRIPTION OF THE EMBODIMENTS

For a better understanding and implementation, the technical solutions in the embodiments of the present disclosure are clearly and completely described below in conjunction with the attached drawings of the present disclosure.

In the description of the present disclosure, it is to be noted that the terms "up", "down", "front", "back", "left", "right", "vertical", "horizontal", "top", "bottom", "inside", "outside" and other orientation or position relationships are based on the orientation or position relationships shown in the attached drawings. It is only intended to facilitate description of the present disclosure and simplify description, but not to indicate or imply that the referred device or element has a specific orientation, or is constructed and operated in a specific orientation. Therefore, they should not be construed as a limitation of the present disclosure.

Unless otherwise defined, all terms including technical and scientific terms used herein have the same meaning as commonly understood by those skilled in the art to which the present disclosure belongs. The terms used herein in the specification of the present disclosure are used only to describe specific embodiments and are not intended as a limitation of the disclosure.

The present disclosure is described in further detail below in conjunction with the attached drawings.

Referring to FIG. 1 to FIG. 13, the biomass fuel burning furnace 100 provided in the embodiment of the present disclosure includes a furnace body 10 and a combustion guide conduit 20.

Referring to FIG. 1 to FIG. 7, a furnace body 10 is provided with a first air inlet 14 for inflowing air into the furnace body 10 and a fuel inlet 15 for feeding biomass fuel into the furnace body 10. The furnace body 10 is provided with a first combustion chamber 11, a second combustion chamber 12, and a third combustion chamber 13 sequentially communicating within the furnace body 10, in which the first combustion chamber 11 is used to receive biomass fuel conveyed from the fuel inlet 15 for an initial combustion of the biomass fuel and a generation of flue gases, the second combustion chamber 12 is used for a combustion of the flue gases and for a mixing of the flue gases with oxygen inflow from the first air inlet 14 to obtain a mixture to be combusted, and the third combustion chamber 13 is used for a combustion of the flue gases in the mixture to be combusted; a combustion guide conduit 20 is connected to the furnace body 10 and connected to the third combustion chamber 13 for directing a flame resulting from the combustion of flue gases in the mixture to be combusted; a fuel-input funnel is mounted on the furnace body 10 and connected to the fuel inlet 15 for feeding biomass fuel into the fuel inlet 15, a side wall of the fuel-input funnel 70 being provided with an adjustable air inlet 723; and a revolving door 90 is rotatably provided with respect to the fuel-input funnel 70, and a gravity center of the revolving door 90 is shifted away from a rotation axis of the revolving door 90, allowing for a closure of the adjustable air inlet 723 under a pressure of the biomass fuel, and for an opening of the adjustable air inlet 723 by own gravity when losing a pressure of the biomass fuel.

The biomass fuel burning furnace 100 mentioned above conveys the biomass fuel to the fuel inlet 15 through the fuel-input funnel 70. Oxygen inflow through the first air inlet 14. The furnace body 10 is configured to include three combustion chambers. The first combustion chamber 11 is used for the initial combustion of biomass fuel. The part that is not burned out becomes flue gas, which enters the second combustion chamber 12, burns in the second combustion chamber 12, and also mixes with oxygen to obtain the mixture to be combusted. The mixture to be combusted enters the third combustion chamber 13 to be completely combusted and the flame produced by combustion is directed upward through a range restricted by the combustion guide conduit 20 to be used for heating, water heating, food cooking, and so on. By providing a combustion guide conduit 20 with a certain length, the flue gas in the mixture to be combusted causes a chimney effect when combusting in the combustion guide conduit 20, so that the hot air flow in the combustion guide conduit 20 creates an intensive convection, creating a negative pumping force at a lower end of the combustion guide conduit 20, which contributes to the atmospheric pressure that presses the external oxygen from the first air inlet 14 to the furnace body 10, so that the oxygen and the flue gas inside the second combustion chamber 12 as well as the flue gas inside the third combustion chamber 13 are further mixed, which contributes to the complete combustion of the flue gas and increases the speed of the flames when ejected from the combustion guide conduit 20. Also, by providing a revolving door 90 on the fuel-input funnel 70 to open and close the adjustable air inlet 723 on the fuel-input funnel 70, when the biomass fuel in the fuel-input funnel 70 finishes combusting, the revolving door 90 may automatically open by gravity, and oxygen may flow into the fuel-input funnel 70 through the adjustable air inlet 723 to break the chimney effect formed by the fuel-input funnel 70, so as to avoid a phenomenon of returning smoke when the flue gas in the combustion guide conduit 20 is returned to the fuel-input funnel 70, which contributes to the complete combustion of the flue gas in the fuel-input funnel 70, and avoids the pollution of the environment by the flue gas. In such a setup, the furnace body 10 in the present embodiment is configured to include three combustion chambers, which achieves staged complete combustion of biomass fuels, which achieves efficient utilization of biomass fuels and avoids pollution of the environment by emitting unburnt flue gases into the air. Also, the combustion efficiency of the biomass fuel is effectively improved by providing the combustion guide conduit 20 to take advantage of the chimney effect.

Specifically, referring to FIG. 1 to FIG. 8, the furnace body 10 of the present embodiment includes a housing 16 and an enclosing frame 17 provided inside the housing 16. The housing 16 is provided with a first air inlet 14. The second combustion chamber 12 is formed within the enclosing frame 17. The enclosing frame 17 is provided with a second air inlet 171 in communication with the first combustion chamber 11 and a first air outlet 172 in communication with the third combustion chamber 13. In such a setup, as the second combustion chamber 12 is in communication with the first air inlet 14 and also provided with a second air inlet 171 in communication with the first combustion chamber 11, the flue gas produced by combustion in the first combustion chamber 11 enters the second combustion chamber 12 from the second air inlet 171 and mixes with the oxygen that enters the second combustion chamber 12 from the first air inlet 14 to obtain the mixture to be combusted, and also part of the flue gas is combusted in the second combustion chamber 12. As the enclosing frame 17 is provided with a first air outlet 172 in communication with the third combustion chamber 13, the mixture to be combusted obtained by mixing in the second combustion chamber 12 enters into the third combustion chamber 13, and then enters into the combustion guide conduit 20, and is sufficiently combusted in the third combustion chamber 13 and the combustion guide conduit 20.

Specifically, for facilitating the setup of the second combustion chamber 12, a part of the combustion guide conduit 20 is provided within the third combustion chamber 13, and the enclosing frame 17 is provided outside the combustion guide conduit 20, and the second combustion chamber 12 is formed by enclosing between the enclosing frame 17 and the combustion guide conduit 20. In such a setup, the second combustion chamber 12 is formed by setting a part of the combustion guide conduit 20 within the third combustion chamber 13, and by setting the enclosing frame 17 outside the combustion guide conduit 20, which facilitates the setting of the second combustion chamber 12. Compared with the way of designing the second combustion chamber 12 by the enclosing frame 17 itself, it is sufficient to set the enclosing frame 17 and the combustion guide conduit 20 to have a gap between them, and the second combustion chamber 12 is formed.

Specifically, referring to FIG. 5 to FIG. 8, the enclosing frame 17 of the present embodiment includes four vertical enclosing plates 173 and a support plate 174 provided on a bottom of the four vertical enclosing plates 173. The support plate 174 is provided with a first air outlet 172. The vertical enclosing plates 173 are enclosed outside the combustion guide conduit 20 and provided with a second air inlet 171. The support plate 174 is connected to the housing 16 and connected to the combustion guide conduit 20. In such a setup, the support plate 174 is supported to the combustion guide conduit 20 and the vertical enclosing plates 173 to achieve the installation of both the combustion guide conduit 20 and the vertical enclosing plates 173. A first air outlet 172 is provided on the support plate 174 to achieve being in communication with the third combustion chamber 13.

It is to be understood that, in order to facilitate the inflow of oxygen from the housing 16 into the second combustion chamber 12, a gap is provided between the vertical enclosing plates 173 and the housing 16, though which the oxygen may inflow.

Further, in order to allow the mixture to be combusted produced in the second combustion chamber 12 to quickly enter the combustion guide conduit 20 for combustion, a part of the combustion guide conduit 20 enclosed by the vertical enclosing plates 173 is provided with a third air inlet 21, and the third air inlet 21 is connected to the second combustion chamber 12. In such a setup, the mixture to be combusted in the second combustion chamber 12 may directly and quickly enter into the combustion guide conduit 20 to allow the flue gases in the mixture to be combusted to be burned in the combustion guide conduit 20 and the flame to be directed out by the combustion guide conduit 20, avoiding lowering the temperature of the mixture to be combusted by means of flowing from the first air outlet 172 through the third combustion chamber 13 and then into the combustion guide conduit 20. Also, the particles being combusted within the second combustion chamber 12 flame up from the third air inlet 21 to contribute to the combustion of the combustible material to be combusted within the combustion guide conduit 20.

Moreover, in order to facilitate the entry of the mixture to be combusted into the combustion guide conduit 20, a first gap 175 is provided on a side of the enclosing frame 17 facing the first combustion chamber 11, the combustion guide conduit 20 is provided with a second gap 22 in an area corresponding to the first gap 175, and a projected arc formed by the second gap 22 on a reference plane in a vertical direction is at least a quarter of the projected circumference formed by the combustion guide conduit 20 on the reference plane. In such a setup, by providing a first gap 175 on the enclosing plates, a larger flow area is available, allowing the flue gases as well as the mixture to be combusted to flow quickly from the second combustion chamber 12 into the combustion guide conduit 20, while the combustion guide conduit 20 is provided with a second gap 22 corresponding to the position of the first gap 175. Due to the Coanda effect, the fluid has a tendency to flow with a surface of the object instead of an original flow direction. Also, since an inner wall of the combustion guide conduit 20 is not absolutely smooth and has protrusions, and the fluid is viscous, the flue gases, as well as the mixture to be combusted, have a tendency to flow along the inner wall of the combustion guide conduit 20 so as to flow along a tangential direction of the combustion guide conduit 20, thereby forming a spiral upward flow pattern. Compared to the combustion mode of direct vertical upward flow along an axial direction of the combustion guide conduit 20, the spiral upward flow takes a longer travel path. Since a length of the combustion guide conduit 20 is a certain length, the combustion time within the combustion guide conduit 20 is a certain period, which leads to a greater flow speed of the spiral flow of the substance to be combusted in order to provide the substance to be combusted with greater fire-power for combustion, which contributes to the rapid combustion of the flue gases, as well as the substance to be combusted, within the combustion guide conduit 20. Also, in conjunction with the chimney effect, a greater pumping force is generated, and air is pressed into the first air inlet 14 more rapidly, achieving rapid mixing of the air in the third combustion chamber 13 and the flue gases in the combustion guide conduit 20.

It is to be understood that, in order to ensure the spiral effect of the airflow on an inner wall of the combustion guide conduit 20, a projected arc formed by the second gap 22 on a reference plane in a vertical direction is required to be less than or equal to half of a projected circumference formed by the combustion guide conduit 20 on the reference plane.

Referring to FIG. 4 to FIG. 7, in an embodiment of the present disclosure, corresponding to the aforementioned air intake structure of the furnace body 10, the combustion guide conduit 20 includes a first section 23, a second section 24, and a third section 25 in sequence from bottom to top. The first section 23 is positioned in the third combustion chamber 13, and a diameter of the first section 23 is increased gradually from bottom to top. The second section 24 is connected to an end of the first section 23 and is enclosed with the enclosing frame 17 to form the second combustion chamber 12, the second section 24 is provided with a third air inlet 21 and a second gap 22, and a diameter of the second section 24 is constant. A diameter of the third section 25 is decreased gradually from bottom to top. In such a setup, as the first section 23 is provided to be positioned within the third combustion chamber 13, oxygen inlet is available, and setting the diameter of the first section 23 to be gradually increased from bottom to top, when the airflow flows from the first section 23 into the second section 24, the airflow may be diffused and the pressure is reduced, and the diffused oxygen may promote the combustion of the flue gases within the combustion guide conduit 20. By setting the diameter of the second section 24 to be constant and the diameter of the third section 25 to be gradually reduced from bottom to top, the high-pressure gas flows out of the third section 25, which has a gradually reduced diameter, with a large flowing speed according to the venturi effect. Also, in conjunction with the chimney effect, the combustion guide conduit 20 is caused to be under negative pressure at a lower end part, which facilitates the compression of oxygen into the third combustion chamber 13 and the second combustion chamber 12, as well as helps the rapid outflow of high-pressure gases to drive the flame from an opening of the combustion guide conduit 20. In such a manner, a rapid airflow circulation is achieved, which contributes to the rapid combustion of the flue gas particles in the mixture to be combusted.

Further, referring to FIG. 4 to FIG. 7, in order to ensure complete combustion of the flue gas particles within the second section 24 and the third section 25, a side wall of the second section 24 is provided with a fourth air inlet 241, and/or a side wall of the third section 25 is provided with a fifth air inlet 251. By means of an air inlet also provided on the second section 24 and/or the third section 25, it contributes to a further supply of oxygen into the second section 24 and/or the third section 25, further contributing to a complete combustion of the flue gas particles.

Specifically, in the present embodiment, a side wall of the second section 24 is provided with a plurality of fourth air inlets 241, and a side wall of the third section 25 is provided with a plurality of fifth air inlets 251. The plurality of fourth air inlets 241 are provided in a straight line in a vertical direction, and the plurality of fifth air inlets 251 are provided in a circumferential array on the third section 25.

Figure 2:
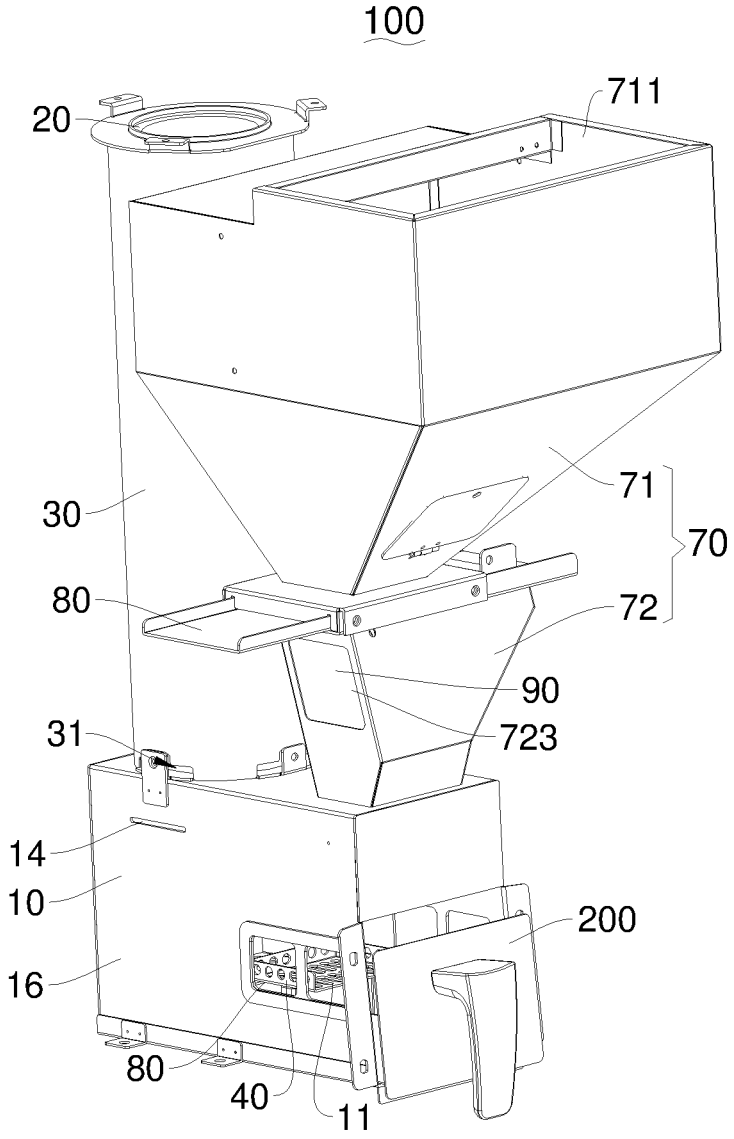
FIG. 2 is a perspective diagram of another view of the biomass fuel burning furnace in FIG. 1.
Figure 3:
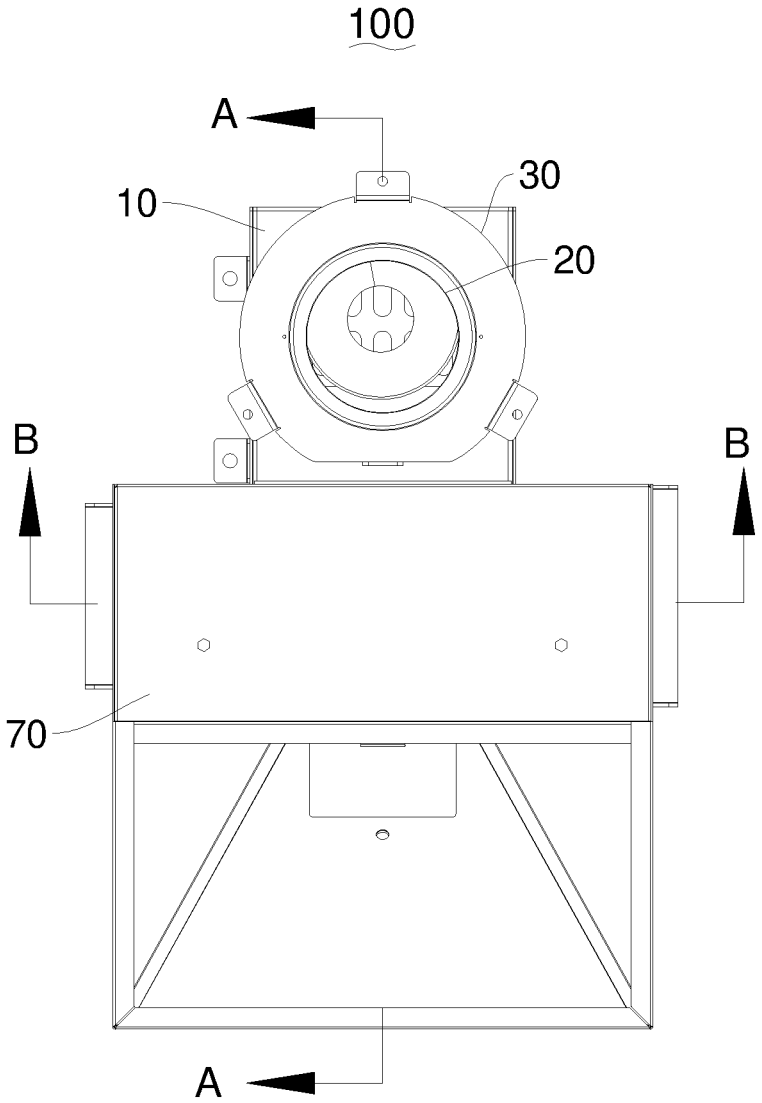
FIG. 3 is a top view of the biomass fuel burning furnace in FIG. 1.
Figure 4:
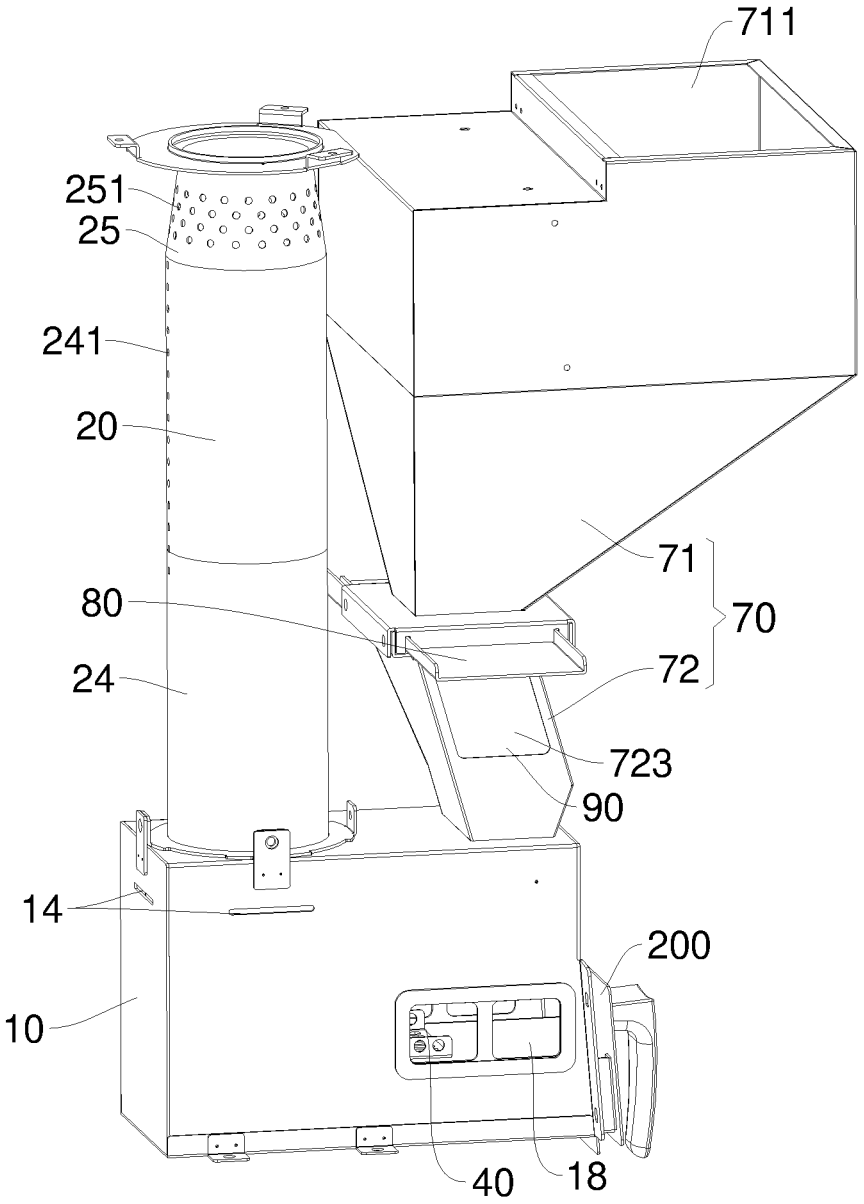
FIG. 4 is a structural diagram of the biomass fuel burning furnace in FIG. 1 with the heat storage cover concealed.
Figure 8:
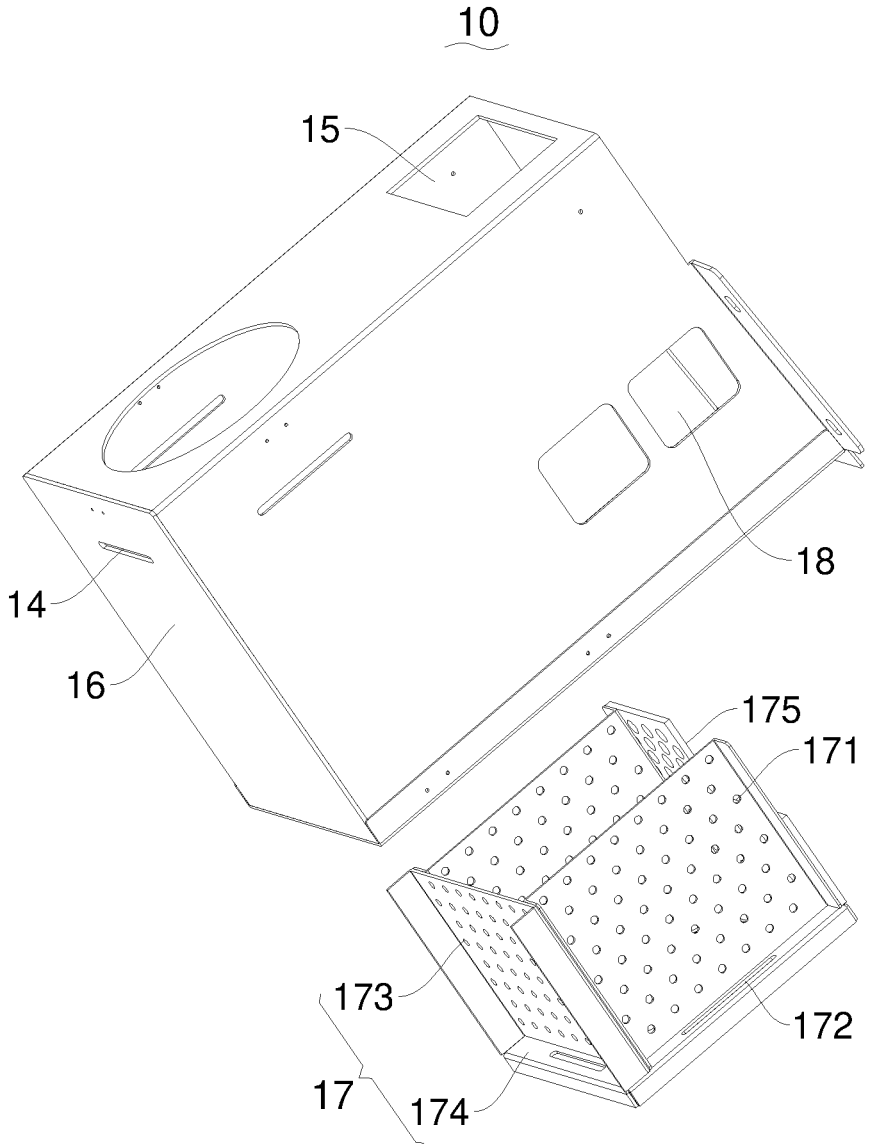
FIG. 8 is a structural diagram of the furnace body in FIG. 1.

Referring to FIG. 1, FIG. 2, and FIG. 8, in the present embodiment, the first air inlet 14 is provided corresponding to the third combustion chamber 13 and the second combustion chamber 12. The furnace body 10 is also provided with a main air inlet 18, the main air inlet 18 is provided corresponding to the first combustion chamber 11, and an opening area of the main air inlet 18 is larger than an opening area of the first air inlet 14. In such a setup, inflow of oxygen is primarily fed through the first air inlet 14 to the third combustion chamber 13 and the second combustion chamber 12, and inflow of oxygen is primarily fed through the main air inlet 18 to the first combustion chamber 11. Since the first combustion chamber 11 is an area for the main combustion of the biomass fuel, by setting the main air inlet 18 with a larger opening area, it is possible to provide more oxygen to the first combustion chamber 11 quickly, avoiding the biomass fuel from having a slower combustion rate due to insufficient supply of oxygen, as well as generating too much flue gas.

Specifically, in the present embodiment, the first air inlet 14 is configured to be in a long-strip shape and is disposed in a horizontal direction, and the height where the first air inlet 14 is opened is relatively low. In such a setup, in conveying oxygen to the second combustion chamber 12 and the third combustion chamber 13 through the first air inlet 14, it is avoided to result in lowering the temperature inside the second combustion chamber 12 and the third combustion chamber 13 due to the opening area of the first air inlet 14 being excessively large, and by providing the first air inlet 14 with a relatively small opening area, the flue gases inside the combustion guide conduit 20 may generate a negative pressure inside the combustion guide conduit 20 by the chimney effect when being combusted, and it is avoided that the negative pressure environment inside the combustion guide conduit 20 may be broken due to the opening area of the first air inlet 14 being relatively large.

Additionally, referring to FIG. 1 and FIG. 2, for ensuring a high temperature environment in the combustion guide conduit 20, the biomass fuel burning furnace 100 further includes a heat storage cover 30 connected to the furnace body 10 and covering outside of both the third section 25 and a part of the second section 24, and the heat storage cover 30 is provided with a sixth air inlet 31 in communication with the fourth air inlet 241 and/or the fifth air inlet 251. In such a setup, by setting the heat storage cover 30 outside the combustion guide conduit 20, i.e., the heat storage cover 30 is covered outside the combustion guide conduit 20, which ensures the high temperature environment in the combustion guide conduit 20, allowing effective combustion of the flue gases in the combustion guide conduit 20.

Specifically, in the present embodiment, when setting the sixth air inlet 31 outside the heat storage cover 30, the sixth air inlet 31 is provided at an end of the heat storage cover 30 connected to the furnace body 10, i.e., at a lower end part of the heat storage cover 30, so as to allow the oxygen entering the sixth air inlet 31 at the lower end part to flow gradually upwardly to flow into the second section 24 and the third section 25 of the combustion guide conduit 20 through the fourth air inlet 241 and the fifth air inlet 251.

It should be understood that, referring to FIG. 2, FIG. 4, FIG. 5 and FIG. 6, in order to improve the combustion efficiency of the entire biomass fuel burning furnace, the biomass fuel burning furnace 100 further includes a first support 40 and a second support 50. The first support 40 is provided on the first combustion chamber 11 to support a heating element for heating the biomass fuel. The second support 50 is provided in the third combustion chamber 13 and positioned below the combustion guide conduit 20 to support a heating element for heating the mixture to be combusted. In such a setup, by setting the first support 40 and the second support 50 to support the heating element respectively, it helps the heating element to heat the biomass fuel or the flue gases. For example, by supporting an alcohol burner or a wax block, the biomass fuel or flue gas is heated by the heat generated by the burning of the alcohol burner or the wax block, which contributes to the rapid combustion of the flue gas in the third combustion chamber 13. Compared to only heating the biomass fuel individually by one heating element, two heating elements simultaneously heating the biomass fuel and the flue gases improves the combustion efficiency of the entire biomass fuel, which further contributes to the rapid combustion of the flue gas particles in the combustion guide conduit 20.

Figure 5:
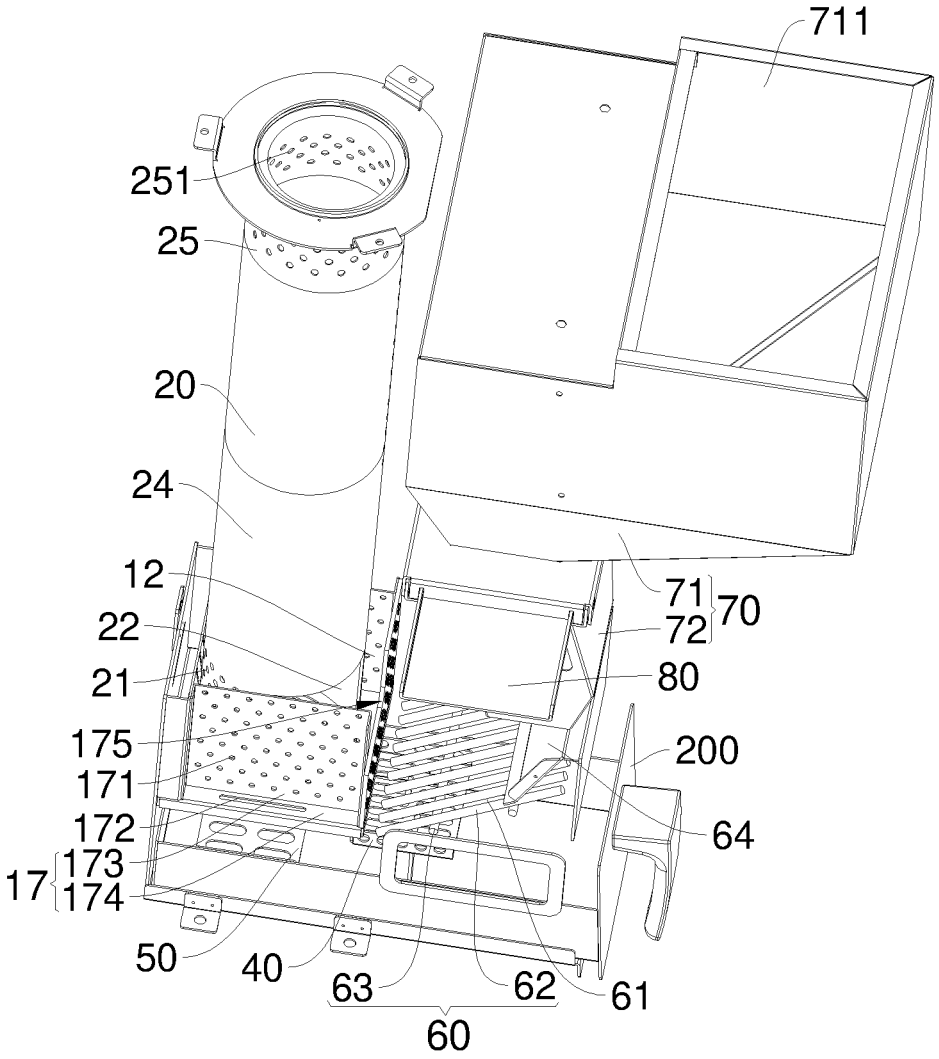
FIG. 5 is a structural diagram of the biomass fuel burning furnace in FIG. 1 with the heat storage cover and the housing concealed.
Figure 6:
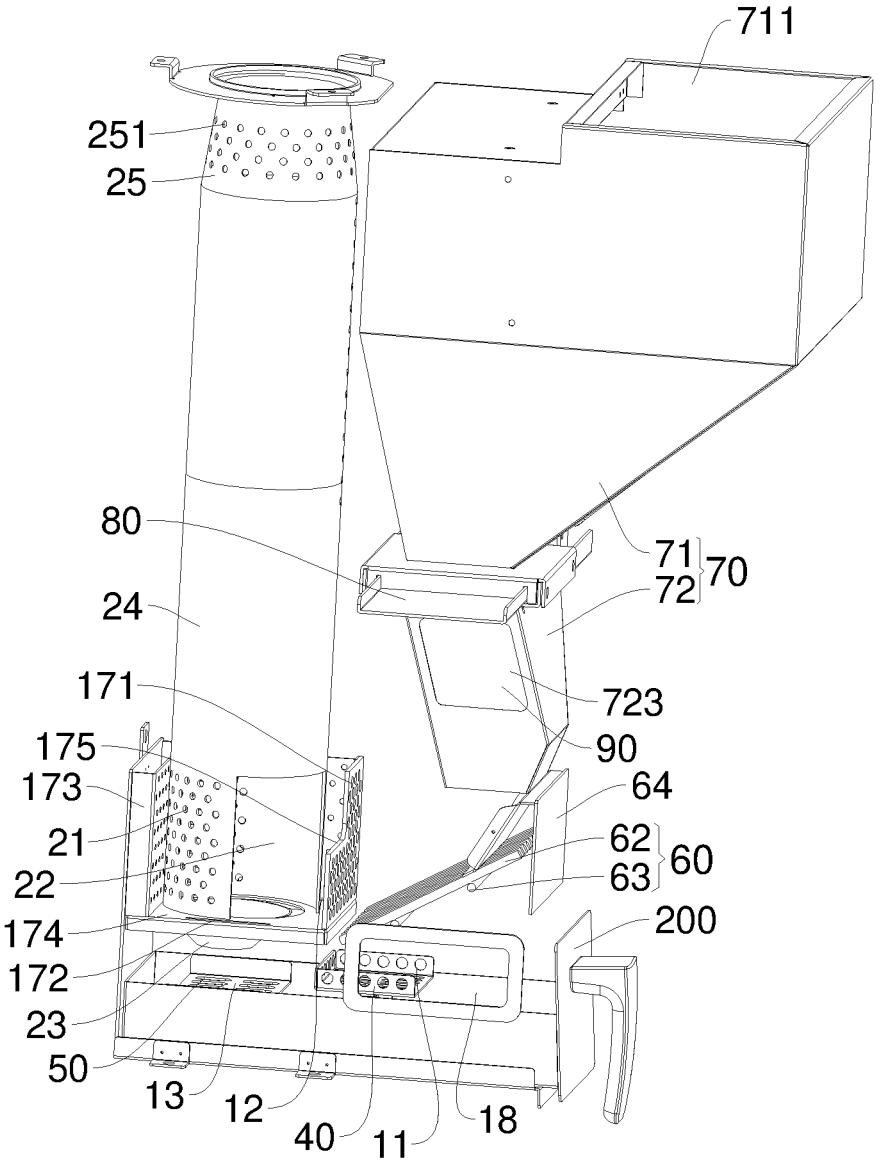
FIG. 6 is a structural diagram of the biomass fuel burning furnace in FIG. 1 with the heat storage cover, the housing, and a part of the vertical enclosing plate concealed.
Figure 7:
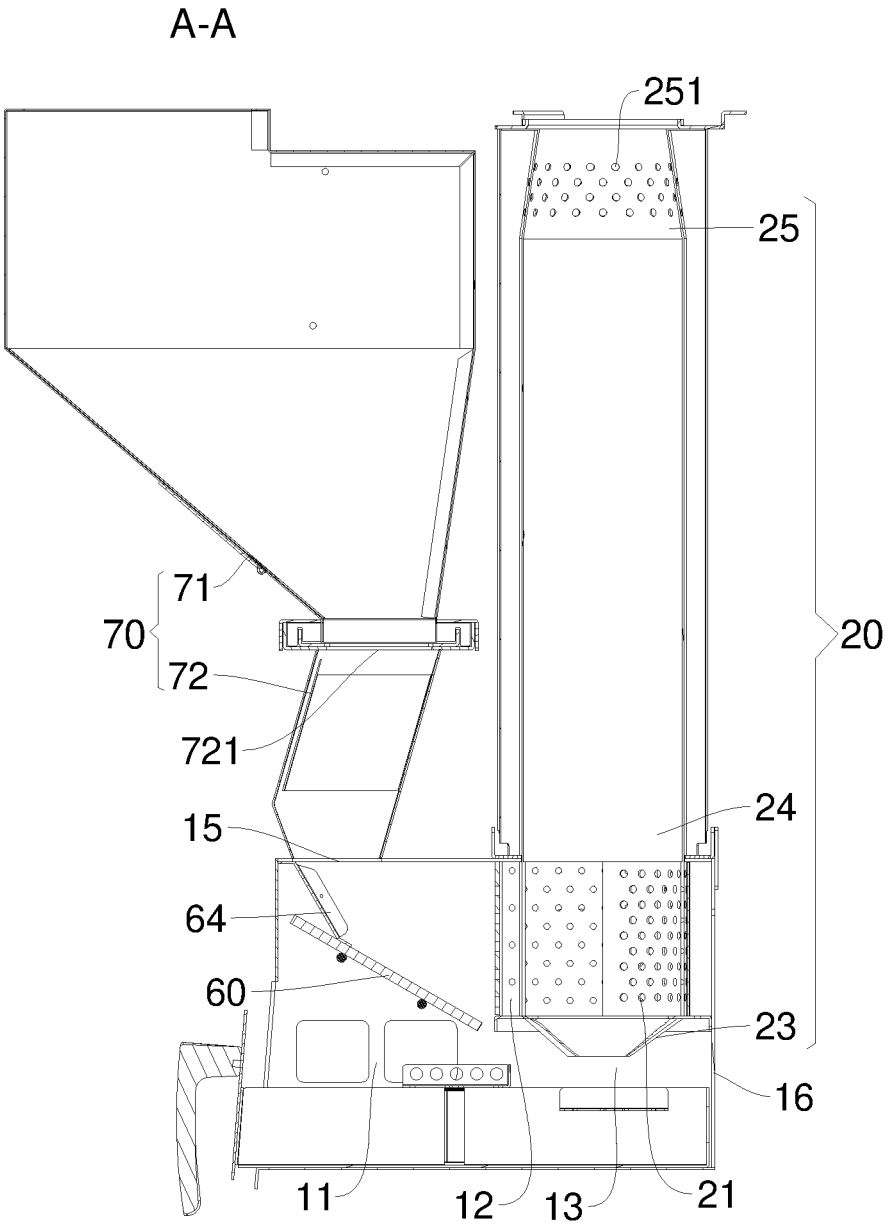
FIG. 7 is a cross-sectional view of FIG. 3 taken along a line A-A.

Referring to FIG. 5 to FIG. 7, in an embodiment of the present disclosure, in order to avoid an excessive accumulation of biomass fuel in the first combustion chamber 11 without efficiently getting heated, the biomass fuel burning furnace 100 further includes a fuel-guiding shelf 60 provided in the first combustion chamber 11 to support the biomass fuel inputted from the fuel inlet 15, and the fuel-guiding shelf 60 is provided with an air inlet gap 61. In such a setup, by setting the fuel-guiding shelf 60, the biomass fuel entering from the fuel inlet 15 may be supported, and the fuel-guiding shelf 60 is provided with an air inlet gap 61 to allow the airflow to enter into the biomass fuel from the air inlet gap 61, so as to avoid the accumulation of the biomass fuel resulting in a state of excessive oxygen deprivation, which leads to the inability of efficiently heating and combustion. Also, by setting the fuel-guiding shelf 60, the biomass fuel is avoided from falling directly onto a bottom wall of the furnace body 10 after entering from the fuel inlet 15 and not being effectively combusted.

Specifically, the fuel-guiding shelf 60 in the present embodiment is provided to be positioned above the first support 40, and the heating element on the first support 40 is positioned below the biomass fuel, so that the heating element on below heats the biomass fuel on above. The heated biomass fuel burns gradually, and the heat is transferred to the inside of the biomass fuel sequentially from bottom to top, which contributes to the combustion of the biomass fuel.

Further, referring to FIG. 5 to FIG. 7, in order to allow the smoke and heat generated by the combustion of the biomass fuel in the first combustion chamber 11 to be quickly directed to the second combustion chamber 12, the fuel-guiding shelf 60 is provided at an upward angle in a direction distal to the second combustion chamber 12, i.e., the fuel-guiding shelf 60 is provided at an angle inside the first combustion chamber 11, the biomass fuel enters from the fuel inlet 15, and is gradually accumulated on the fuel-guiding shelf 60, so that the heat and the gases are directly directed to the second combustion chamber 12 to allow rapid entry into the second combustion chamber 12 when burning takes place.

Specifically, in the present embodiment, the fuel-guiding shelf 60 includes a plurality of fuel-guiding tubes 62 and a plurality of connecting tubes 63. The plurality of fuel-guiding tubes 62 are spaced apart, between each adjacent two fuel-guiding tubes 62 is the air inlet gap 61, each fuel-guiding tube 62 is provided angled upwardly in a direction distal to the second combustion chamber 12, and the plurality of connecting tubes 63 are connected to the fuel-guiding tubes 62 respectively, i.e., the fuel-guiding shelf 60 is provided in a form of a supporting frame formed by a plurality of tubes connected to each other, so as to allow for setting up the air inlet gap 61 between the tubes, so that oxygen may effectively enter into the biomass fuel positioned on above through the gaps between the tubes.

It is to be understood that, referring to FIG. 1 to FIG. 7, in order to facilitate the transfer of ash generated by the combustion of the biomass fuel in the first combustion chamber 11, the biomass fuel burning furnace 100 further includes an ash receiver 200, the ash receiver 200 being mounted to the furnace body 10 in a form of a drawer, so as to facilitate the pulling out of the ash for transfer. In order to help biomass fuel inputted from the fuel inlet 15 to fall onto the fuel-guiding shelf 60, the biomass fuel burning furnace 100 further includes an adapter frame 64, in which the adapter frame 64 is connected to a side wall of the fuel inlet 15 to be abutted against the fuel-guiding shelf 60, so as to guide biomass fuel inputted from the fuel inlet 15 to the fuel-guiding shelf 60 orderly.

Referring to FIG. 1 to FIG. 7 and FIG. 9 to FIG. 12, in an embodiment of the present disclosure, in order to allow for continuous feeding of biomass fuel into the furnace body 10, the biomass fuel burning furnace 100 further includes a fuel-input funnel 70 mounted on the furnace body 10 and in communication with the fuel inlet 15. In such a setup, by setting up the fuel-input funnel 70, a larger amount of biomass fuel may be input into the fuel-input funnel 70 all at once to temporarily store the biomass fuel through the fuel-input funnel 70, and the biomass fuel within the fuel-input funnel 70 may slowly fall from the fuel inlet 15 when the biomass fuel in the first combustion chamber 11 is burning and gradually reduced. Also, the biomass fuel inputted from the input opening 711 of the fuel-input funnel 70 may be replenished simultaneously for continuous replenishment of the biomass fuel within the first combustion chamber 11 to ensure that the first combustion chamber 11 may be kept in a state of continuous combustion.

Further, referring to FIG. 1, FIG. 2, FIG. 4 to FIG. 6 and FIG. 9 to FIG. 12, in order to facilitate control of the on-off of the biomass fuel feeding into the fuel inlet 15, the biomass fuel burning furnace 100 further includes a sliding separator 80, the sliding separator 80 being slidably disposed with respect to the fuel-input funnel 70 and/or the furnace body 10 to open or close the fuel inlet 15, so that the fuel inlet 15 may be conveniently opened or closed by pushing the sliding separator 80 to control the on-off state of the biomass fuel entering into the fuel inlet 15.

Specifically, referring to FIG. 1, FIG. 2, FIG. 4 to FIG. 6 and FIG. 9 to FIG. 12, in order to avoid that the biomass fuel in the fuel-input funnel 70 continues to be combusted after the fuel inlet 15 is closed, the fuel-input funnel 70 includes a fuel-input section 71 and a buffer section 72 in sequence from top to bottom, and the buffer section 72 is connected to the first combustion chamber 11, and the sliding separator 80 is slidably disposed between the fuel-input section 71 and the buffer section 72, which is equivalent to the sliding separator 80 being disposed in a middle of the fuel-input funnel 70. When the fuel inlet 15 is closed, there is a certain distance between the sliding separator 80 and the fuel inlet 15, i.e., there is a certain height difference between the sliding separator 80 and the first combustion chamber 11, so as to avoid the risk of the continued combustion of the biomass fuel in the fuel-input section 71 occurring due to the flames and the heat being transferred to the sliding separator 80, and then from the sliding separator 80 to the biomass fuel in the fuel-input section 71 when the biomass fuel in the first combustion chamber 11 continues to be combusted after the fuel inlet 15 is closed.

Figure 11:
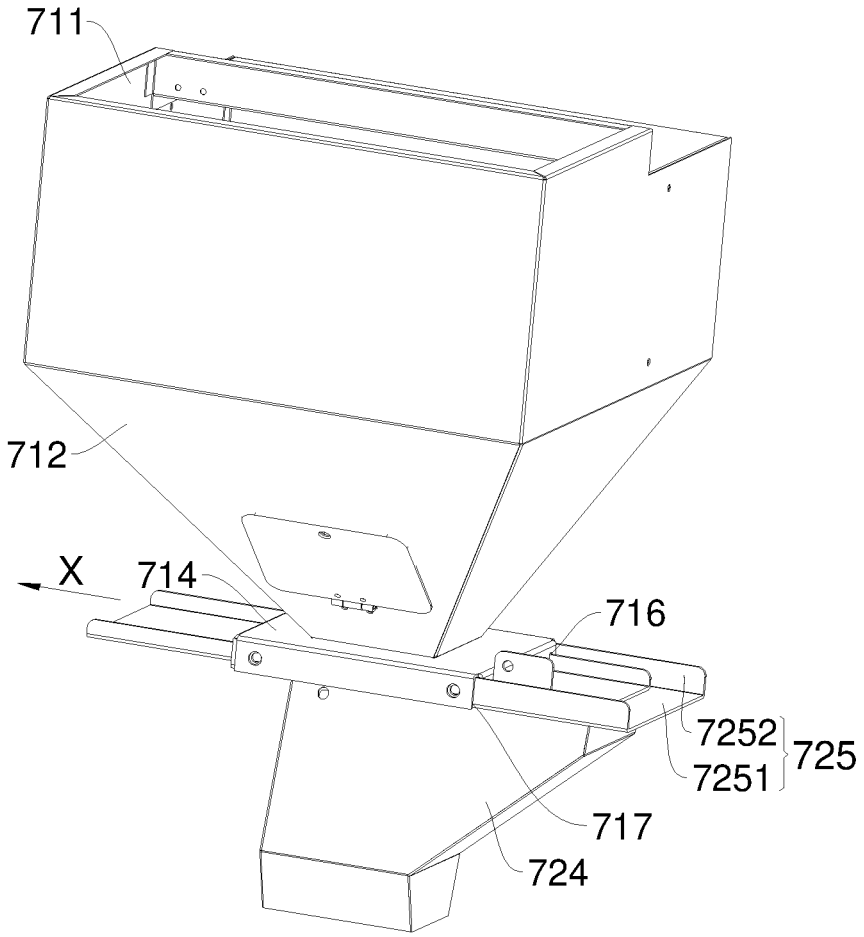
FIG. 11 is a structural diagram of the fuel-input funnel in FIG. 1.
Figure 12:
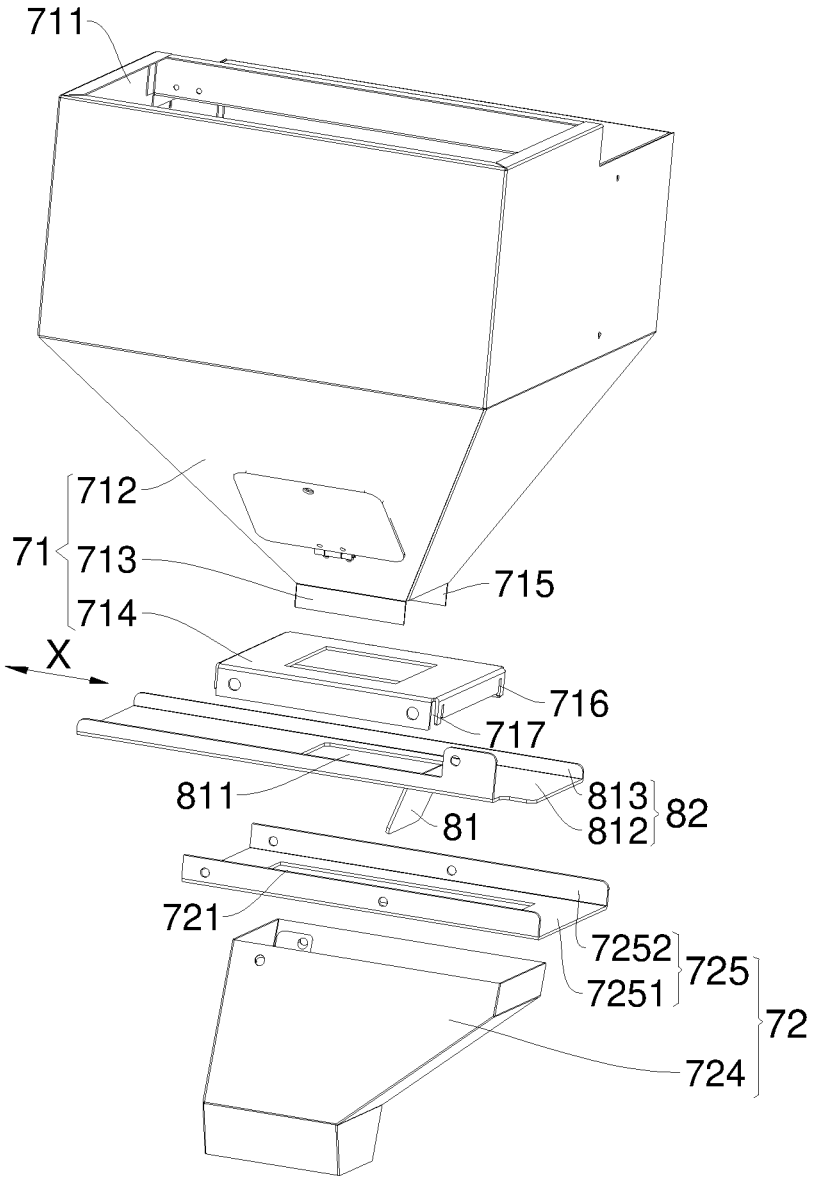
FIG. 12 is a disassembly diagram of the fuel-input funnel in FIG. 11.
Figure 13:
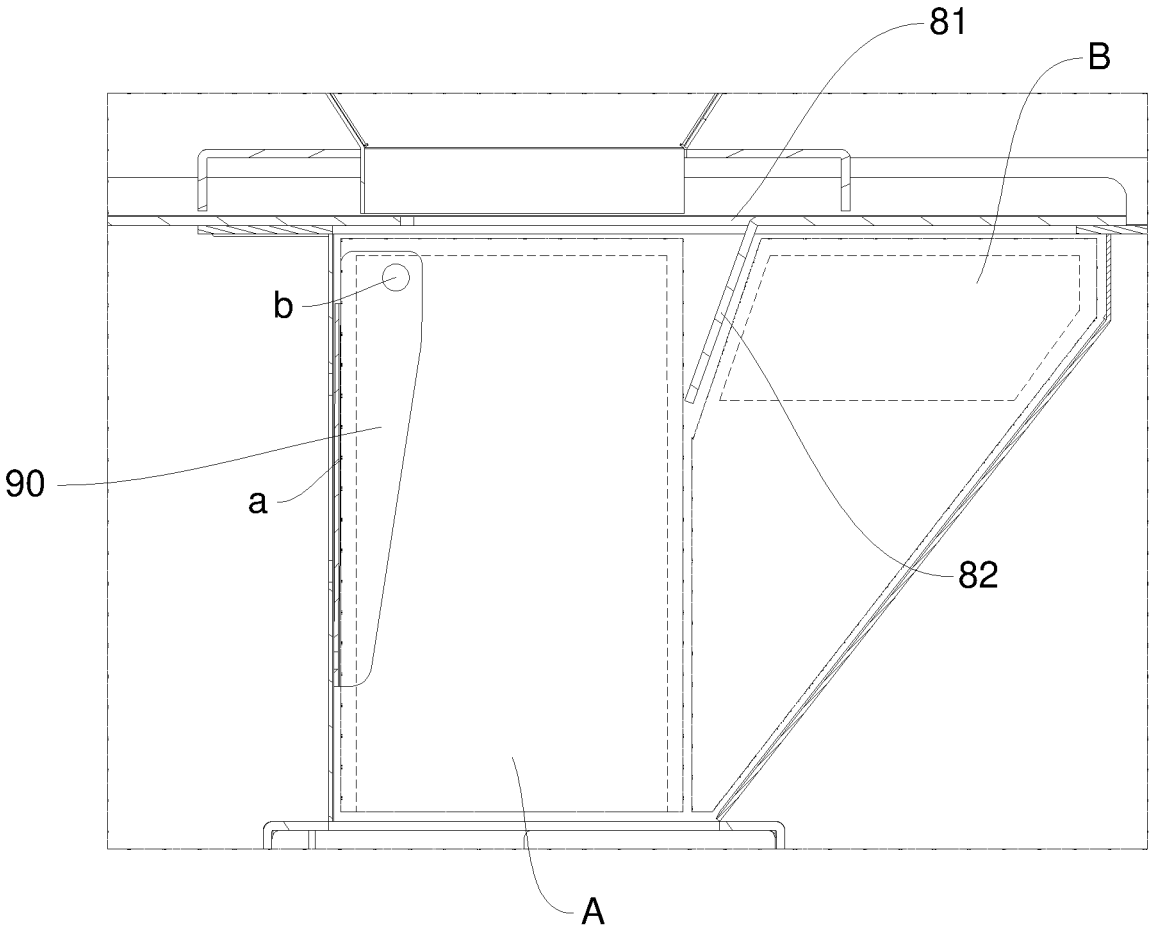
FIG. 13 is a diagram of the revolving door in FIG. 9 when closed against the adjustable air inlet.

Specifically, referring to FIG. 9 to FIG. 13, in the present embodiment, the sliding separator 80 includes a barrier part 81 and a fuel-guiding part 82, the barrier part 81 is slidably provided between the fuel-input section 71 and the buffer section 72 for opening or closing a communicating opening 721, in communication with the fuel-input section 71, of the buffer section 72, and the fuel-guiding part 82 is provided angled upwardly in a direction from the furnace body 10 to the fuel-input section 71. Therefore, the sliding separator 80 is not only provided with the barrier part 81 for opening or closing the fuel inlet 15 but also provided with an angled fuel-guiding part 82. When the biomass fuel falls gradually from the fuel-input section 71, as shown in FIG. 13, the biomass fuel falls from the drop zone A. Due to the obstruction of the fuel-guiding part 82 of the sliding separator 80, there is a vacant zone B positioned between a rear side of the fuel-guiding part 82 and a side wall of the buffer section 72, and the vacant zone B is not filled with the biomass fuel. When pushing the barrier part 81 to slide for closing the buffer section 72, the biomass fuels, which are of a certain hardness, accumulate with each other and are of high resistance to the pushing of the sliding separator 80, thereby hindering the sliding of the barrier part 81. By angling the fuel-guiding part 82 of the sliding separator 80 to allow the forming of the vacant zone B for releasing pressure, the fuel-guiding part 82 gradually moves toward the vacant zone B when the sliding separator 80 is gradually pulled, thereby achieving pressure relief until the barrier part 81 covers the buffer section 72.

Further, in order to allow the biomass fuel within the buffer section 72 to flow to the fuel inlet 15, the buffer section 72 is provided at an angle corresponding to a side wall of the fuel-guiding part 82, and the side wall and the fuel-guiding part 82 share a same angled direction. For facilitating the description, the angled provided side wall is defined as the angled side wall 722. In such a setup, by setting the angled side wall 722, the biomass fuel is guided to gradually move toward a bottom of the fuel-guiding part 82.

Figure 9:
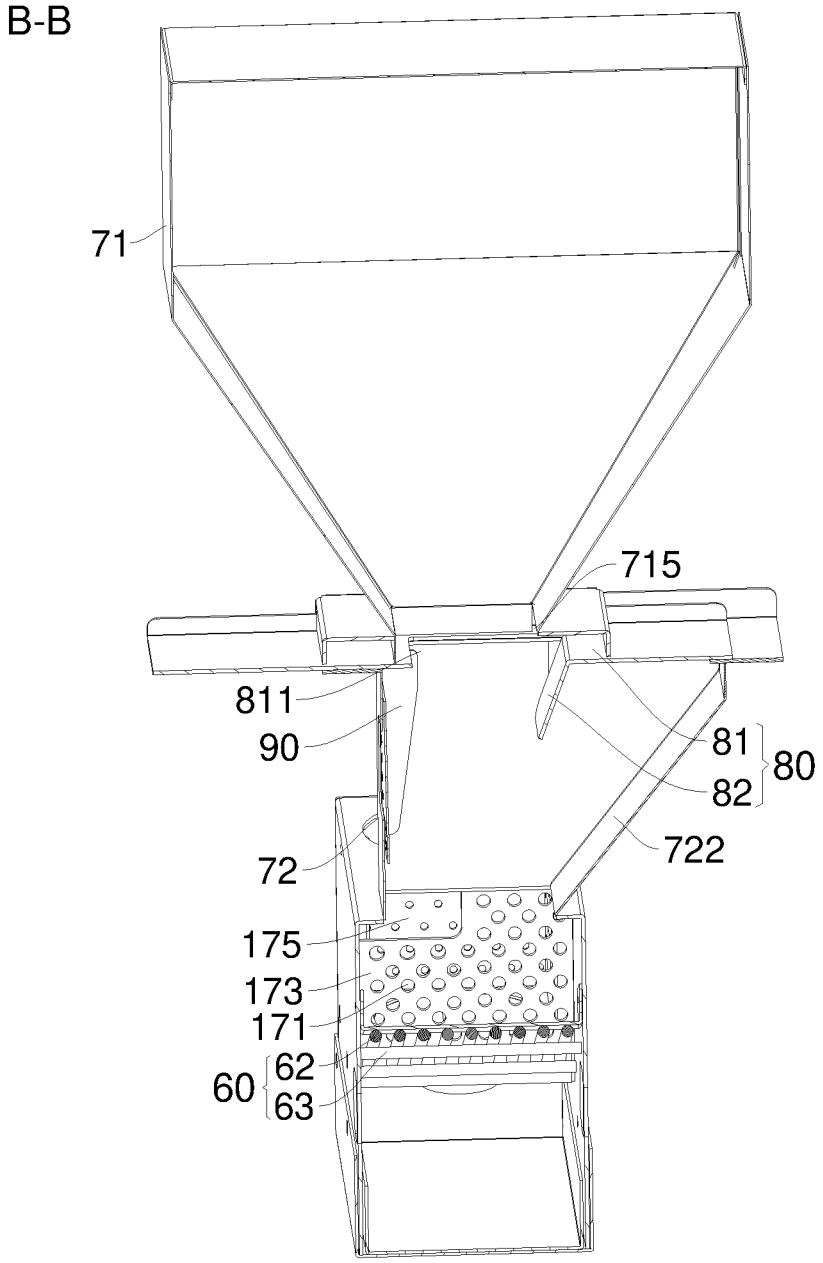
FIG. 9 is a cross-sectional view of FIG. 3 taken along a line B-B.
Figure 10:
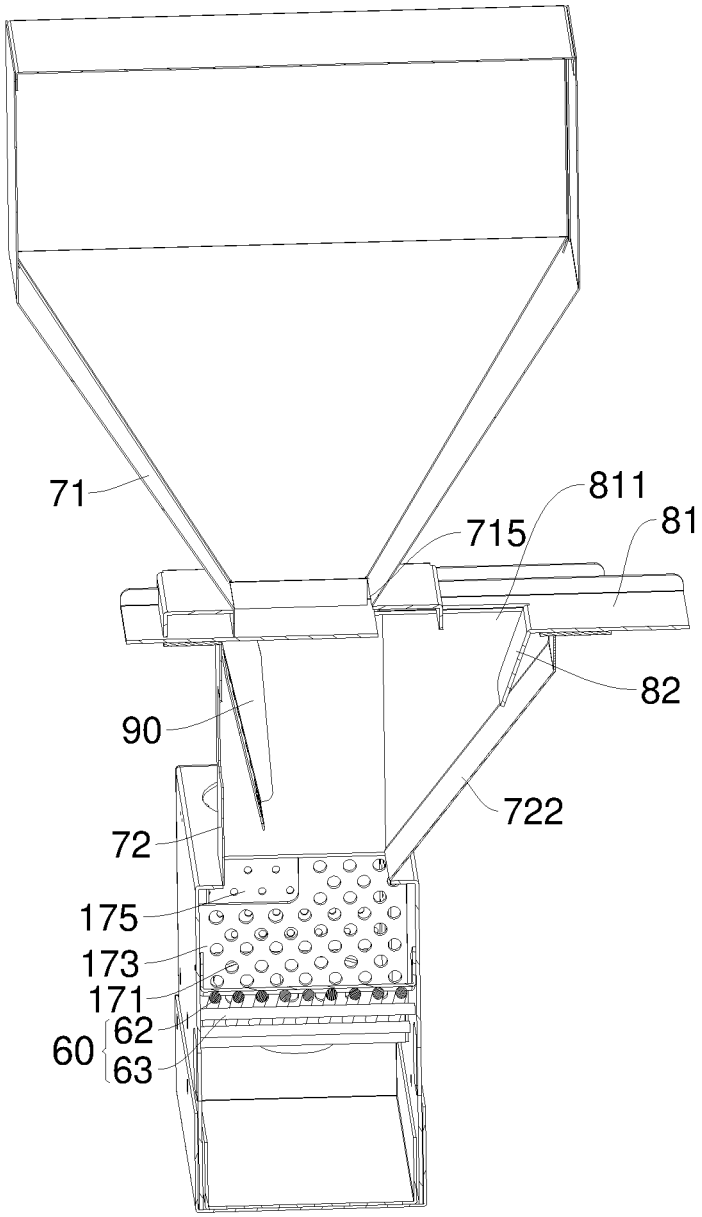
FIG. 10 is a structural diagram of the sliding separator in FIG. 9 after blocking the fuel-input opening.

Referring to FIG. 9, FIG. 10 and FIG. 12, the barrier part 81, in opening and closing the buffer section 72, is specified in such a way that the barrier part 81 is provided with a fuel-input opening 811 for being in communication with the communicating opening 721 to open the fuel inlet 15 by the barrier part 81 or for crisscrossing the communicating opening 721 to close the fuel inlet 15 by the barrier part 81. In such a setup, by setting the fuel-input opening 811 on the barrier part 81, in comparison to directly setting the entire barrier part 81 in a shape of a plate to open and close the fuel inlet 15, when the fuel inlet 15 is opened or closed, it may be achieved by pulling the barrier part 81 to move by a relatively small distance.

Referring to FIG. 11 and FIG. 12, a structural diagram of the fuel-input funnel 70 is shown, in which the fuel-input section 71 is provided with an input opening 711 and includes a funnel part 712, a guiding part 713 and a restricting part 714. The guiding part 713 is positioned on a lower end of the funnel part 712 and is integrated with the funnel part 712. A third gap 715 is formed on the guiding part 713 in a movement direction X along the sliding separator 80, and the guiding part 713 is inserted in the restricting part 714, so that the biomass fuel entering from the funnel part 712 flows to the buffer section 72 through the guiding part 713 and the restricting part 714 in sequence, and the guiding part 713 is extended in a vertical direction to allow for downward guidance of the biomass fuel.

The restricting part 714 is provided with a sliding slot 716 for sliding the sliding separator 80, while restricting the sliding separator 80 to slide in a straight line in the X direction. Specifically, in sliding relative to the restricting part 714, the barrier part 81 includes a horizontal plate 812 and a vertical plate 813, the horizontal plate 812 is provided with a fuel-input opening 811 for being in communication with the communicating opening 721, and the vertical plate 813 is used to slide along the restricting part 714 in the sliding slot 716, so as to drive the crossing and overlapping between the fuel-input opening 811 and the communicating opening 721 of the buffer section 72, so as to achieve the closure and opening of the fuel inlet 15 of the furnace body 10.

Further, for facilitating mounting of the fuel-input section 71 and the sliding separator 80, the buffer section 72 includes a buffer part 724 and a mounting part 725 disposed at a top of the buffer part 724, in which the mounting part 725 is provided with a communicating opening 721, and the mounting part 725 includes a mounting plate 7251 and an insertion plate 7252, with the mounting plate 7251 disposed in a horizontal direction, and the insertion plate 7252 disposed in a vertical direction. When mounting the fuel-input section 71 and the sliding separator 80, the restricting part 714 of the fuel-input section 71 is provided with an insertion slot 717, and the insertion plate 7252 is inserted into the insertion slot 717, while the horizontal plate 812 of the sliding separator 80 is slid along the mounting plate 7251 and the restricting part 714, so as to achieve the closure and opening of the fuel inlet 15 of the furnace body 10.

In such a setup, by setting a third gap 715 on a side of the guiding part 713 along the movement direction X, when the sliding separator 80 is slid along the X direction to perform a closure of the fuel inlet 15, the biomass fuel within the fuel-input section 71 may gradually move along the third gap 715 under the support of the horizontal plate 812, so as to achieve for a slow release of the pressure, and to avoid an excessive resistance to the movement of the sliding separator 80 due to the accumulated biomass fuel when the sliding separator 80 is being pulled.

Referring to FIG. 1, FIG. 2, FIG. 4, FIG. 9, FIG. 10, FIG. 13 and FIG. 14, in an embodiment of the present disclosure, in order to avoid any return of smoke from the combustion guide conduit 20, the biomass fuel burning furnace 100 further includes a revolving door 90, the fuel-guiding part 82 is provided with an adjustable air inlet 723, the revolving door 90 is rotatably provided with respect to the fuel-guiding part 82, and a gravity center of the revolving door 90 is shifted away from a rotation axis of the revolving door 90, allowing for a closure of the adjustable air inlet 723 under the gravity of the biomass fuel, and for an opening of the adjustable air inlet 723 by the own gravity when the biomass fuel finishes combustion. In such a setup, when combustion of the biomass fuel is required, the biomass fuel enters the buffer section 72 from the fuel-input section 71, and then enters the first combustion chamber 11 from the buffer section 72. The biomass fuel gradually falls and is accumulated in the buffer section 72, and applies pressure to the revolving door 90 to press the revolving door 90 against the adjustable air inlet 723 to achieve the closure of the adjustable air inlet 723. When the buffer section 72 is closed by sliding the retainment plate 91, the biomass fuel positioned in the buffer section 72 gradually falls into the first combustion chamber 11 to gradually complete combustion, at which time the revolving door 90 loses the compression of the biomass fuel and is able to be rotated, and since the gravity center of the revolving door 90 is shifted away from the rotation axis of the revolving door 90, the revolving door 90 is rotated along its own rotating axis to open the adjustable air inlet 723. In this case, the adjustable air inlet 723 allows air to enter, avoiding a vacuum state in the buffer section 72 when the biomass fuel in the buffer section 72 completes combustion, which results in the flue gases in the second combustion chamber 12 and the third combustion chamber 13 returning to the buffer section 72, and thus results in the biomass fuel not being completely combusted.

Specifically, referring to FIG. 13, the rotating center of the revolving door 90 is b, the gravity center of the revolving door 90 is a, and they are not positioned on the same line.

Figure 14:
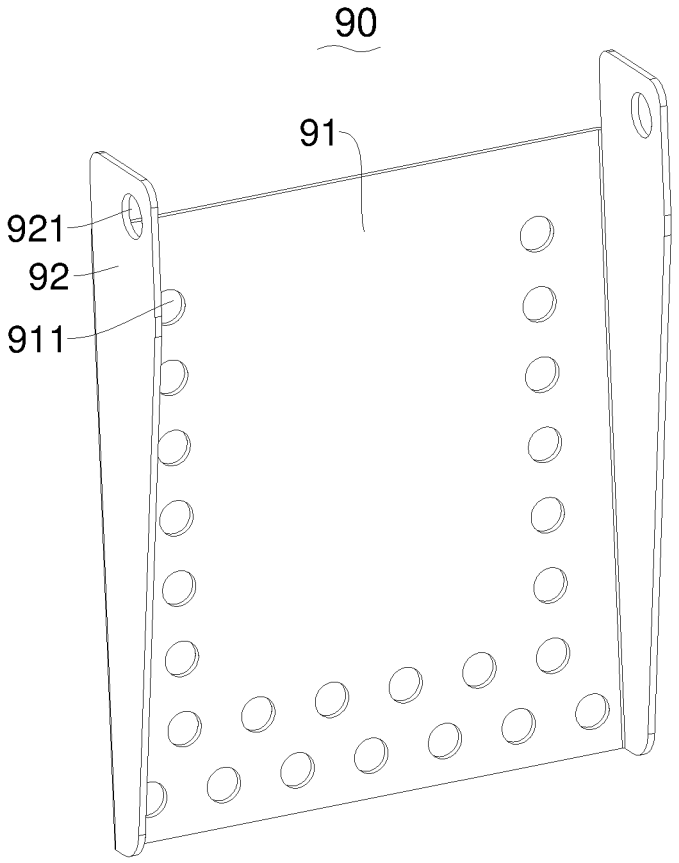
FIG. 14 is a structural diagram of the revolving door in FIG. 9.

Specifically, referring to FIG. 14, the revolving door 90 includes a retainment plate 91 and two lateral plates 92 provided on two opposite sides of the retainment plate 91. Two lateral plates 92 are provided with connecting holes 921 through which a rotating shaft is provided to open and close the adjustable air inlet 723 by means of the retainment plate 91.

It is to be understood that, since the gravity center of the revolving door 90 and the center of the rotating shaft deviate from each other, the center of the entire revolving door 90 in the present embodiment is positioned on the retainment plate 91, but the center of the rotating shaft is positioned on the connecting center of the two connecting holes 921. In such a setup, when the biomass fuel in the buffer section 72 is burned out, the revolving door 90 is rotated around the rotating axis so as to disengage the adjustable air inlet 723 in order to achieve the opening of the adjustable air inlet 723, thereby avoiding the return of smoke in the buffer section 72.

Further, after the biomass fuel in the buffer section 72 finishes combustion, in order to allow more rapid entry of air into the buffer section 72, the retainment plate 91 may be provided with an eighth air inlet 911, so that the air entering from the adjustable air inlet 723 may also flow rapidly from the eighth air inlet 911 into the buffer section 72.

In the biomass fuel burning furnace 100 mentioned above, the furnace body 10 is configured to include the first combustion chamber 11, the second combustion chamber 12, and the third combustion chamber 13. The first combustion chamber 11 is used for the initial combustion of biomass fuel. The flue gas particles mix with oxygen in the second combustion chamber 12 to obtain the mixture to be combusted. The flue gases in the mixture to be combusted enter the third combustion chamber 13 to be completely combusted and the flame produced by combustion is directed rapidly through the combustion guide conduit 20. The furnace body 10 is further provided with a fuel-input funnel 70 to continuously convey biomass fuel to the furnace body, which ensures the first combustion chamber 11 to be in a state of continuous combustion. The fuel-input funnel 70 is configured to include the fuel-input section 71, the buffer section 72, and the sliding separator 80, in which the sliding separator 80 closes or opens the fuel inlet 15, which prevents spontaneous combustion of the biomass fuel above the sliding separator 80 after the sliding separator 80 closes against the fuel inlet 15. The buffer section 72 is configured with the revolving door 90 and the adjustable air inlet 723, so that the revolving door 90 is capable of opening and closing the adjustable air inlet 723 to avoid the presence of flue gases flowing from the combustion guide conduit 20 in the buffer section 72, i.e., avoid the phenomenon of returning flue gases.

In summary, the biomass fuel burning furnace provided in the present disclosure has technical effects as follows:

The biomass fuel is conveyed through the fuel inlet. Oxygen inflow through the first air inlet. The furnace body is configured to include three combustion chambers. The first combustion chamber is used for the initial combustion of biomass fuel. The part that is not burned out becomes flue gas, which enters the second combustion chamber, burns in the second combustion chamber, and also mixes with oxygen to obtain the mixture to be combusted. The mixture to be combusted enters the third combustion chamber to be completely combusted and the flame produced by combustion is directed upward through a range restricted by the combustion guide conduit to be used for heating, water heating, food cooking, and so on. By providing a combustion guide conduit with a certain length, the flue gas in the mixture to be combusted causes a chimney effect when being combusted in the combustion guide conduit, so that the hot air flow in the combustion guide conduit creates an intensive convection, creating a negative pumping force at a lower end of the combustion guide conduit, which contributes to the atmospheric pressure that presses the external oxygen from the first air inlet to the furnace body, so that the oxygen and the flue gas inside the second combustion chamber, as well as the flue gas inside the third combustion chamber, are further mixed, which contributes to the complete combustion of the flue gas and increases the speed of the flames when ejected from the combustion guide conduit. Also, by providing a revolving door on the fuel-input funnel to open and close the adjustable air inlet on the fuel-input funnel, when the biomass fuel in the fuel-input funnel finishes being combusted, the revolving door may automatically open by gravity, and oxygen may flow into the fuel-input funnel through the adjustable air inlet to break the chimney effect formed by the fuel-input funnel, so as to avoid the phenomenon of returning smoke when the flue gas in the combustion guide conduit is returned to the fuel-input funnel, which contributes to the complete combustion of the flue gas in the fuel-input funnel, and avoids the pollution of the environment by the flue gas.

The technical means disclosed in the solution of the present disclosure are not limited to those disclosed in the embodiments mentioned above but also include technical solutions consisting of any combination of the above technical features. It should be noted that for those skilled in the art, a plurality of improvements and modifications may be made without departing from the principles of the present disclosure. These improvements and modifications are also considered to be within the scope of protection of the present disclosure.

The invention claimed is:

1. A biomass fuel burning furnace, comprising:

a furnace body, provided with a first air inlet for inflowing air into the furnace body and a fuel inlet for feeding biomass fuel into the furnace body, provided with a first combustion chamber, a second combustion chamber, and a third combustion chamber sequentially communicating within the furnace body, wherein the first combustion chamber is used to receive biomass fuel conveyed from the fuel inlet for an initial combustion of the biomass fuel and a generation of flue gases, the second combustion chamber is used for a combustion of the flue gases and for a mixing of the flue gases with oxygen inflow from the first air inlet to obtain a mixture to be combusted, and the third combustion chamber is used for a combustion of the flue gases in the mixture to be combusted;

a combustion guide conduit, connected to the furnace body and connected to the third combustion chamber for directing a flame resulting from the combustion of flue gases in the mixture to be combusted;

a fuel-input funnel, mounted on the furnace body and connected to the fuel inlet for feeding biomass fuel into the fuel inlet, a side wall of the fuel-input funnel being provided with an adjustable air inlet; and a revolving door, rotatably provided with respect to the fuel-input funnel, and a gravity center of the revolving door being shifted away from a rotation axis of the revolving door, allowing for a closure of the adjustable air inlet under a pressure of the biomass fuel, and for an opening of the adjustable air inlet by own gravity when losing a pressure of the biomass fuel.

2. The biomass fuel burning furnace according to claim 1, wherein the furnace body comprises a housing and an enclosing frame provided within the housing;

the housing is provided with the first air inlet; and the second combustion chamber is formed within the enclosing frame, wherein the enclosing frame is provided with a second air inlet in communication with the first combustion chamber and a first air outlet in communication with the third combustion chamber.

3. The biomass fuel burning furnace according to claim 2, wherein a part of the combustion guide conduit is provided within the third combustion chamber, the enclosing frame is enclosed out of the combustion guide conduit, and the second combustion chamber is formed by enclosing between the enclosing frame and the combustion guide conduit.

4. The biomass fuel burning furnace according to claim 3, wherein the enclosing frame comprises a plurality of vertical enclosing plates and a support plate provided below the plurality of vertical enclosing plates, the vertical enclosing plate is provided with the second air inlet, and the support plate is for mounting the combustion guide conduit and is provided with the first air outlet.

5. The biomass fuel burning furnace according to claim 4, wherein a part of the combustion guide conduit enclosed by the vertical enclosing plate is provided with a third air inlet, and the third air inlet is in communication with the second combustion chamber.

6. The biomass fuel burning furnace according to claim 5, wherein a side of the enclosing frame facing the first combustion chamber is provided with a first gap, a second gap is provided in an area, corresponding to the first gap, of the combustion guide conduit, and a projected arc formed by the second gap on a reference plane in a vertical direction is at least a quarter of a projected circumference formed by the combustion guide conduit on the reference plane.

7. The biomass fuel burning furnace according to claim 6, wherein the combustion guide conduit comprises a first section, a second section and a third section in sequence from bottom to top;

the first section is positioned in the third combustion chamber, and a diameter of the first section is gradually increased from bottom to top;

the enclosing frame and an end of the second section connected to the first section are enclosed to form the second combustion chamber, the second section is provided with the third air inlet and the second gap, and a diameter of the second section is constant; and a diameter of the third section is gradually decreased from bottom to top.

8. The biomass fuel burning furnace according to claim 7, wherein a side wall of the second section is provided with a fourth air inlet, and/or a side wall of the third section is provided with a fifth air inlet.

9. The biomass fuel burning furnace according to claim 1, further comprising a heat storage cover connected to the furnace body and covering the combustion guide conduit positioned out of the furnace body.

10. The biomass fuel burning furnace according to claim 1, wherein the first air inlet is provided corresponding to the third combustion chamber and the second combustion chamber, the furnace body is further provided with a main air inlet, the main air inlet is provided corresponding to the first combustion chamber, and an opening area of the main air inlet is larger than an opening area of the first air inlet.

11. The biomass fuel burning furnace according to claim 1, further comprising a first support and a second support;

the first support is provided in the first combustion chamber to support a heating element for heating the biomass fuel; and the second support is provided in the third combustion chamber and positioned below the combustion guide conduit to support a heating element for heating the mixture to be combusted.

12. The biomass fuel burning furnace according to claim 1, further comprising a fuel-guiding shelf, provided in the first combustion chamber, used to support the biomass fuel inputted from the fuel inlet, and provided with an air inlet gap.

13. The biomass fuel burning furnace according to claim 12, wherein the fuel-guiding shelf is disposed angled upwardly in a direction distal to the second combustion chamber.

14. The biomass fuel burning furnace according to claim 1, further comprising a sliding separator slidably provided with respect to the fuel-input funnel and/or the furnace body to open or close the fuel inlet.

15. The biomass fuel burning furnace according to claim 14, wherein the fuel-input funnel comprises a fuel-input section and a buffer section in sequence from top to bottom, the buffer section is connected to the first combustion chamber, and the sliding separator is slidably provided between the fuel-input section and the buffer section.

16. The biomass fuel burning furnace according to claim 15, wherein the sliding separator comprises a barrier part and a fuel-guiding part, the barrier part is slidably provided between the fuel-input section and the buffer section for opening or closing a communicating opening, connected to the fuel-input section, of the buffer section, and the fuel-guiding part is provided angled upwardly in a direction from the furnace body to the fuel-input section.

17. The biomass fuel burning furnace according to claim 16, wherein a side wall of the buffer section corresponding to a sliding direction of the fuel-guiding part is disposed at an angle, and the side wall and the fuel-guiding part share a same angled direction.

18. The biomass fuel burning furnace according to claim 16, wherein the barrier part is provided with a fuel-input opening for being in communication with the communicating opening to open the fuel inlet by the barrier part or for crisscrossing the communicating opening to close the fuel inlet by the barrier part.

19. The biomass fuel burning furnace according to claim 17, wherein the barrier part is provided with a fuel-input opening for being in communication with the communicating opening to open the fuel inlet by the barrier part or for crisscrossing the communicating opening to close the fuel inlet by the barrier part.

* * * * *